United States Patent [19]

Carmichael

[11] Patent Number: 4,769,948

[45] Date of Patent: Sep. 13, 1988

[54] CAVITY MOUNTED DOOR CONSTRUCTION

[76] Inventor: Roy W. Carmichael, 4 Bulls Road, Burraneer, N.S.W. 2230, Australia

[21] Appl. No.: 710,244

[22] Filed: Mar. 11, 1985

[30] Foreign Application Priority Data

Mar. 12, 1984 [AU] Australia ..... PG4024

[51] Int. Cl.[4] ..... E05F 11/39

[52] U.S. Cl. ..... 49/372; 49/409; 49/504; 16/94 R; 248/340

[58] Field of Search ..... 49/372, 504, 409, 425; 52/712, 714, 715, 648; 16/94 R; 248/320, 340

[56] References Cited

U.S. PATENT DOCUMENTS

| | | | |
|---|---|---|---|
| 807,762 | 12/1905 | Miller | 16/94 R |
| 822,090 | 5/1906 | Wideman | 16/94 R |
| 2,378,666 | 6/1945 | Triller | 49/372 |
| 3,049,765 | 8/1962 | Elmore | 49/504 |
| 3,058,174 | 10/1962 | Sterling | 49/372 |
| 3,072,975 | 1/1963 | Burmeister | 49/409 |
| 3,722,170 | 3/1973 | Jones | 248/320 |

FOREIGN PATENT DOCUMENTS

| | | | |
|---|---|---|---|
| 537567 | 2/1957 | Canada | 16/94 R |

*Primary Examiner*—Peter A. Aschenbrenner
*Assistant Examiner*—Gerald A. Anderson
*Attorney, Agent, or Firm*—Beveridge, DeGrandi & Weilacher

[57] ABSTRACT

A track supports a sliding door for movement into and out of a cavity formed in a wall. The end region of the track within the door-receiving cavity rests on a supporting surface to which it is unattached. The door moves between jambs with lower ends provided with vertical slots which receive tongues which extend upwardly from the opposite sides of a horizontal plate attached to the floor.

6 Claims, 5 Drawing Sheets

CAVITY MOUNTED DOOR CONSTRUCTION

TECHNICAL FIELD

This invention relates to the construction of sliding doors of the kind which, in the open position, are located within a pocket or cavity in the wall adjacent the doorway, this kind of sliding door being commonly, as here, referred to as a cavity mounted sliding door.

BACKGROUND ART

The construction of such doors which is most commonly used in Australia involves the manufacture of a pre-assembled pocket comprising vertical jamb and rear members and horizontal rails. This pocket is installed within an opening provided in the wall to accommodate the pocket and the doorway, and a removeable door track is mounted within the pocket and extending across the doorway.

In order that the track may be installed after fixing-out is complete, and to enable its removal for cleaning or other maintenance, in these prior art arrangements the track is supported within the pocket by the engagement of bayonet slots with spigots located respectively adjacent the inner end of the track and in the region of the jamb near the centre of the track. The track is, of course, subsequently fixed to the head of the door opening.

Although this approach has enabled cavity mounted doors to be installed with considerable economy, several disadvantages have been inherent in the procedures employed. As the track has been mounted on spigots (which may be formed by screws) located in slots on a side flange, it has been necessary to specify left or right handed fixing. As the load of the door is carried in cantilever fashion from the side flange, some twisting or bending of the track will occur, this being particularly troublesome where rails of inadequate stiffness are employed.

A further disadvantage which this prior art system has in common with its more complex and expensive alternatives such as permanently installed top-suspended tracks, is the inability of the track to accommodate inaccuracies in wall construction or warping of the door or pocket, and these may result in scraping or jamming of the door at some point within the pocket.

A considerable problem encountered in the prior art arises from the difficulty of actually locating the track end slot on the inner spigot. As the fixer is literally working in the dark, there are occasions where the end spigot is not engaged in its slot, with unsatisfactory installation resulting.

The present invention provides an approach to the hanging of cavity mounted sliding doors which overcomes these disadvantages.

The invention is also directed to the provision of a cavity mounted door construction which facilitates the use of such doors more readily with thin-wall construction, and which is more readily adaptable to the variations in wall thickness which are found in practice.

DISCLOSURE OF INVENTION

According to the present invention there is provided apparatus for the mounting of a cavity mounted sliding door comprising a track member adapted for the support of runners from which said door is suspended, a support engaging formation on said track substantially midway between the ends thereof, and support means comprising a supporting surface by which the end region of said track within said cavity may be supported by resting on said supporting surface but being unattached thereto.

In a further aspect, the invention provides a cavity mounted door construction comprising a pair of vertical jamb members between which said door may pass in operation, means for the attachment of said jambs to a floor, said attachment means comprising a horizontal plate portion adapted for affixture to said floor and at least one upwardly extending member disposed on opposite sides of said plate so as to be respectively engageable with said jamb members, thereby to fix the separation of said jamb members at the foot thereof.

BRIEF DESCRIPTION OF THE DRAWINGS

To facilitate an understanding of the present invention, reference will now be made to the accompanying drawings, where a presently proposed embodiment of the invention is illustrated by way of example.

DESCRIPTION OF PREFERRED EMBODIMENT

Figure 1:
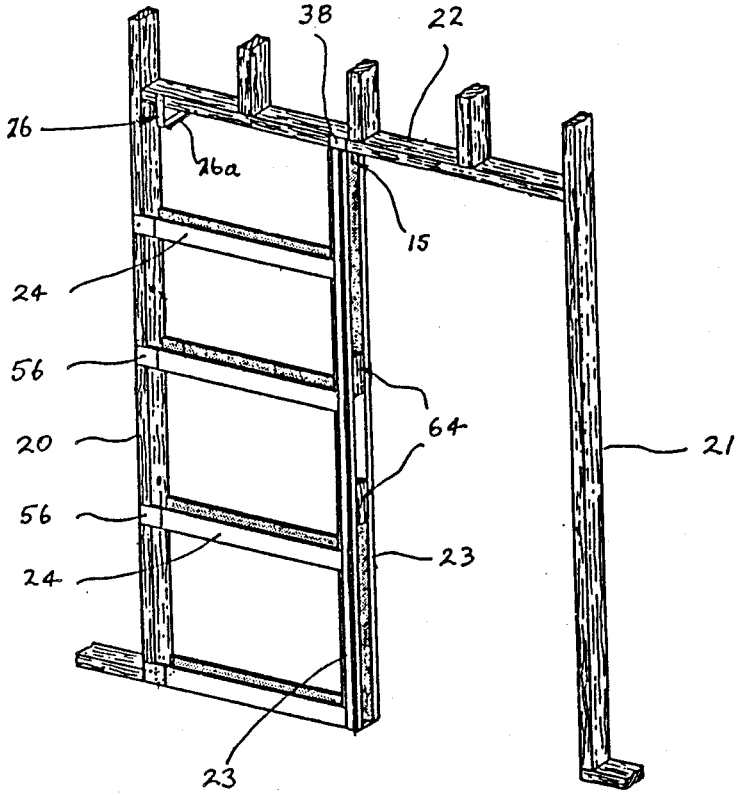
FIG. 1 shows a cavity mounted sliding door installation embodying the present invention, prior to fixing and fitting-out.

As seen in FIG. 1, an opening is provided in a timber stud wall, this opening being bounded by studs 20 and 21 and a head member 22.

Fixed between the floor and the header 22 are a pair of opposed, identical split jambs 23, the construction of these being described in detail below. Optional rails 24 may also be provided, as also described below.

On the inner face of each split jamb member 23 adjacent its upper end a spigot 25 is provided as referred to above, and a U-shaped cradle 26 is mounted on the inner end of the member 12. In this way a door track 27, (not shown in FIG. 1 but illustrated in FIGS. 8 and 9) provided with a centrally located, spigot-engaging aperture 44, may after fixing and fitting out, be inserted within the pocket and its inner end located within the cradle 26 to rest on the horizontal bight portion 26*a*. The central slot of the track flange may then be engaged with the spigot 25, the latter being readily visible due to its proximity to the doorway.

The split jamb members 23 in this embodiment comprise extruded aluminium members 28, provided with wood filling pieces 29.

Figure 2:
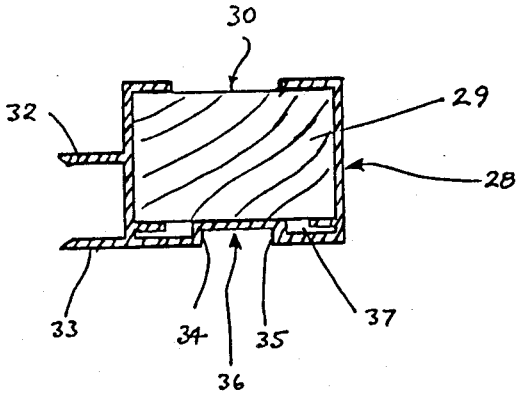
FIG. 2 is a horizontal cross section view of one of the split jambs employed in the embodiment of FIG. 1.
Figure 14:
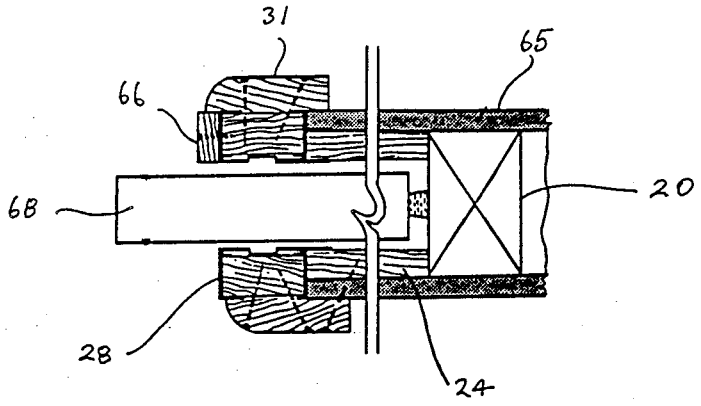
FIG. 14 is a fragmentary horizontal cross-section of a sliding door assembly, and, FIG. 15 is a fragmentary end elevation of part of the assembly of FIG. 14.
Figure 15:
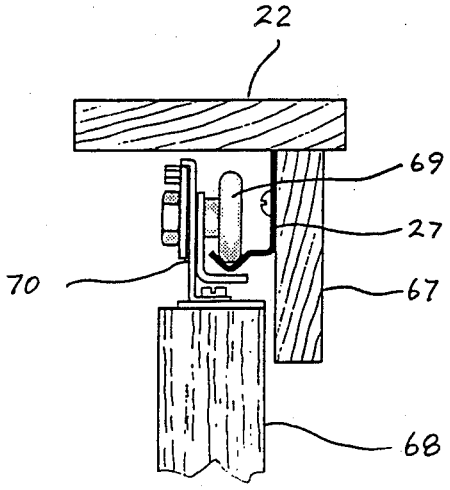

As shown in the cross-sectional view FIG. 2, the outer side face of the extrusion 28 provides a wide slot 30 enabling the fixing of architraves 31 (FIG. 14) by nails driven in to the wood filling member 29.

A pair of parallel flanges 32 and 33 are provided extending rearwardly from the inner end face of the extrusion 28, to receive the end of each rail 24.

As also shown in FIG. 2, the inner side face of the member 28 is stepped inwardly at 34 and 35 to form a central outwardly facing groove 36 and, on either side of this, a pair of inwardly facing grooves 37. These grooves are provided to enable the split jamb members readily to be located at their upper and lower ends by foot and head pieces illustrated in FIGS. 3 to 7.

Figure 3:
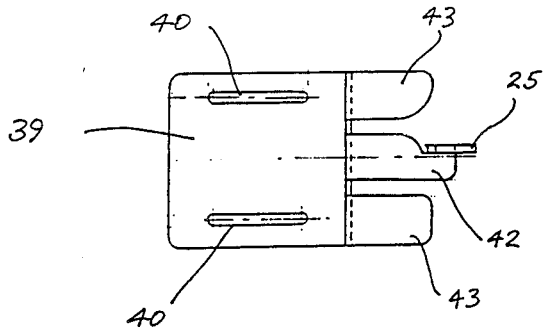
FIG. 3 is a side elevation of a head piece for cooperation with the jamb of FIG. 2.
Figure 4:
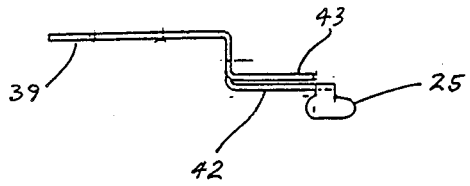
FIG. 4 is an end elevation of the head piece.

As illustrated in FIGS. 3 and 4, each head piece 38 comprises a plate portion 39 which is provided with a pair of parallel vertical slots 40 for the passage of nails or other fastening devices, whereby the head piece may be fixed to the head 22.

A web portion 41 extends inwardly (relative to the door when the piece 38 is assembled with its jamb 23), and extending downwardly from this web are three tongues, a central tongue 42, and a pair of side tongues 43.

The central tongue 42 lies in a plane spaced inwardly of the cavity from the plane containing the side tongues 43, and has at its lower end a portion bent at right angles to the plane of the tongue and shaped to constitute a spigot 25 for engagement with a support engaging formation such as the central aperture 44 of the rail 27.

The spacing between the planes respectively containing the tongues 42 and 43 corresponds to that between the grooves 36 and 37 of the member 28, so that the member 38 may be assembled with a split jamb 23 by engagement of the tongues 43 within the grooves 37 and the tongue 42 within the groove 36. Two such head pieces 38 are provided, one for each split jamb 23.

Figure 5:
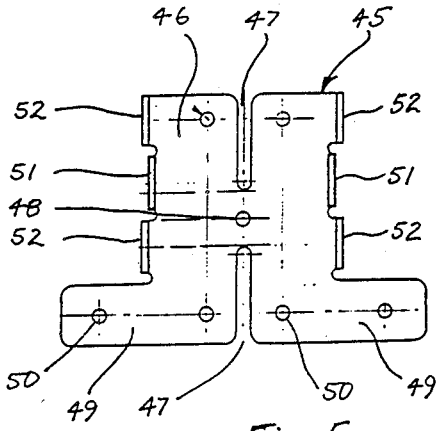
FIG. 5 is a plan view of a foot piece for cooperation with a pair of split jambs.
Figure 6:
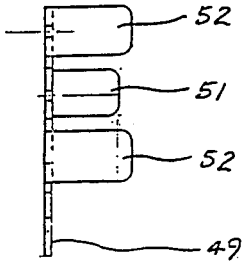
FIG. 6 is a side elevation of the foot piece.
Figure 7:
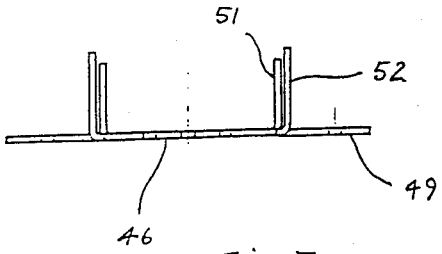
FIG. 7 is an end elevation of the foot piece.

The foot piece 45 by which the lower ends of the split jambs 23 are fixed to the floor or other base surface is shown in FIGS. 5 to 7. This piece 45 comprises a bottom plate 46 partially divided by aligned slots 47 with a central nail hole 48 and a pair of outwardly extending portions 49 provided with nail holes 50.

Bent up from each side of the plate 46 is a central tongue 51 and a pair of side tongues 52, which like the tongues 42 and 43 of the head pieces 38, are relatively displaced so that the bottom piece 45 may be assembled with the bottom ends of the split jambs 23 by the engagement of the central tongue 51 in the groove 36 and the side tongues 52 into grooves 37.

The purpose of the slots 47 is to enable the foot piece 45 readily to be cut through to form a pair of separated foot pieces where the jamb spacing is required to be increased beyond that set by the spacing of the tongues 51 and 52 of each side of the foot piece, to accommodate a door of greater thickness.

Figure 8:
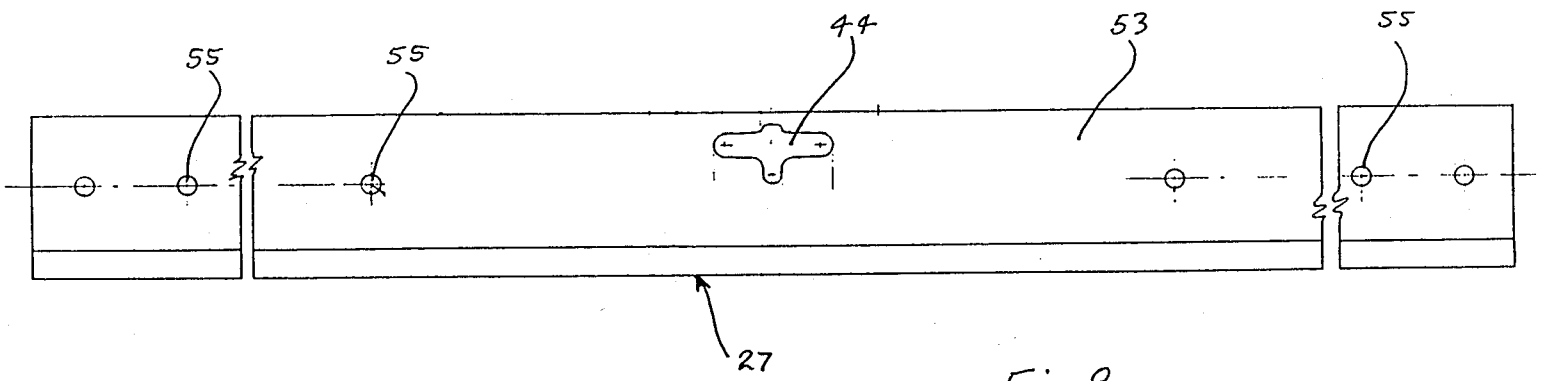
FIG. 8 is a side elevation of a track for use in the illustrated embodiment.
Figure 9:
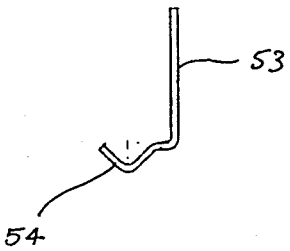
FIG. 9 is an end elevation of the track.

As will be seen in FIGS. 8 and 9, the rail 27 is a track means designed symmetrically about its vertical centreline, so that it may be installed either left- or right-handed, that is to say, on either side of the door cavity. The rail comprises a web 53 and a flange 54 contoured to provide a track for the rollers on which the door is supported as is well known in the art. Screw holes 55 are provided in the web 53 on either side of the spigot aperture 44.

Figure 11:
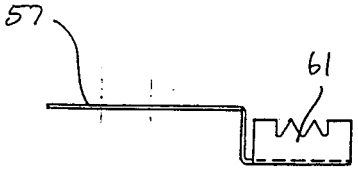
FIG. 11 is a plan view of the end piece.
Figure 10:
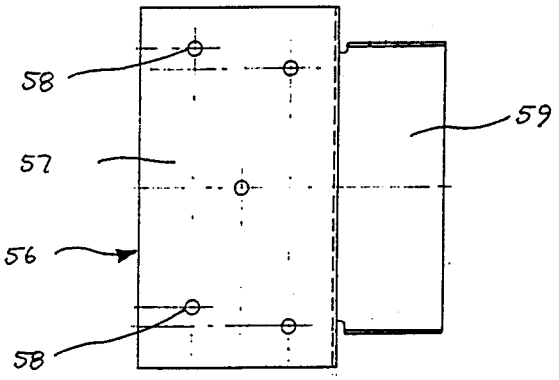
FIG. 10 is a side elevation of a stud end piece.

To facilitate the fastening of the rail ends to the stud 20, the preferred form of the invention provides stud end pieces 56, (FIGS. 10 and 11) each comprising a plate 57 provided with nail holes 58 for fastening the end piece to the stud 20, a web 59 and a laterally displaced flange 60, the latter comprising bent-up side portions 61 provided with a toothed free edge. In the factory, rails 24 are pre-assembled with end pieces 56, the rail ends being located within the portions 59, 60 and gripped by crimping the toothed portions 60 inwardly.

Figure 13:
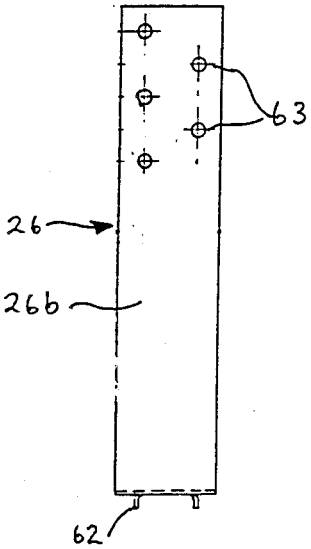
FIG. 13 is a side elevation of the cradle.
Figure 12:
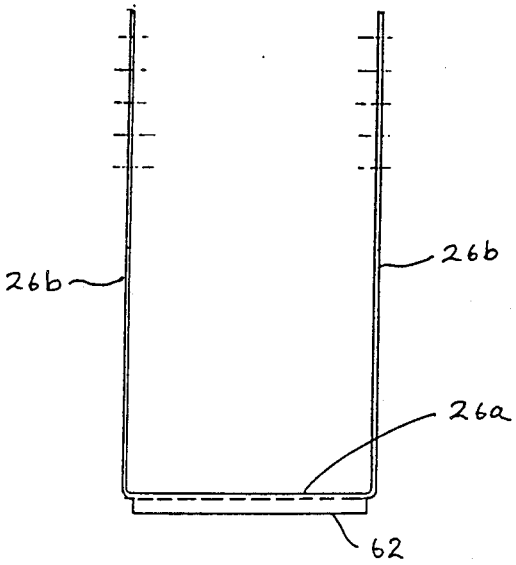
FIG. 12 is an end elevation of a cradle for use in the illustrated embodiment.

The cradle 26 is illustrated in FIGS. 12 and 13 and comprises a bight portion **26*a* stiffened by downwardly bent flanges 62, and side legs 26*b* provided with a pattern of apertures 63** for nails, screws or other fasteners.

The cavity mounted sliding door track, jamb and pocket kit is preferably supplied with the two split jambs 23 held together by the foot piece 45 and by their attachment to a temporary spacing blocks 64 (FIG. 1) which aid the fixing-out process. The head pieces 38 are pre-assembled with the upper ends of the split jambs 23.

The erection procedure is then as follows. First the jambs 23 are fixed to the header 22 by nailing the head pieces 38 thereto. The jambs are then plumbed and fixed to the finished floor level by means of the foot piece 45.

Next the track is located on the spigot 25 and levelled. The cradle 26 is then attached to the head member 22 to support the level track inwardly of its end, and the track is then removed to await installation of the door after fixing-out is completed.

If the side rails 24 are to be employed, these are next assembled by inserting their outer ends between the flanges 32 and 33 of the split jamb member 28, and nailing the end pieces 56 to the stud 20.

At the appropriate time for fixing out, the wall sheets 65 (FIG. 14) may be applied, preferably by gluing to the rails 24, the architraves 31 and jamb lining members 66 (which are of course optional) are attached, the latter by nailing through the outer end face of the member 28 or by drilling and screwing.

When fixing-out is complete, the track 27 is located by inserting its inner end into the cradle 26 and locating its central slot on the spigot 25. It should be observed that as the slot in the track is centrally located, and the cradle 26 supports the track by its lower surface, the need for differing right and left handed arrangements is eliminated. Spigots 25 are of course provided on each of the split jamb head pieces members 38 for this purpose.

The track is then fixed, level, to the fixed pelmet 67 attached to the head member 22 above the door opening, and the door 68 may be installed after removal of the spacing strips 23.

The door 68 is supported in the conventional manner from the tracks 27 by runners 69 mounted on the upper edge of the door by bracket assemblies 70, these components being covered by a removable pelmet (not shown) in the conventional manner.

It will be appreciated from this description of an example of one way in which the present invention may be put into practice, that the invention provides many advantages over the prior art, many of which were mentioned in the preamble. Without sacrificing removability of the track, the construction illustrated enables fool-proof location of the inner end of the track and supports that inner end from beneath thereby reducing problems associated with twisting or bending of the track. Because the inner end of the track is free to move laterally both during installation and during operation of the door, warping of the door or irregularities in the wall are no longer such a problem as in the prior art.

Particularly by eliminating the need for a pre-assembled pocket, the jamb arrangement provides the maximum available door space within the pocket, assisting in the application of the invention to thin-wall constructions, and providing increased tolerance for variation in finished stud sizes.

In addition to allowing the simple attachment of trim members, the timber fill in the jamb members 23 combines with the extrusion 28 to provide a light and sufficiently rigid, yet economical jamb.

While the invention has been described in relation to a specific embodiment, it will be appreciated that its principles will find embodiment in many other forms, and the scope of the invention is therefore not regarded as having been limited in any way by the specific description of the preferred embodiment.

What is claimed:

1. Apparatus for mounting a cavity mounted sliding door, comprising, track means for supporting runners from which said door is suspended, a support engaging formation on said track means substantially midway between the ends thereof, and support means for supporting said track means within said cavity, said support means having a horizontal supporting surface, said track means having an inner end region which rests on and is supported by said supporting surface, said inner end region of the track being laterally movable on the horizontal supporting surface of the support means during installation and during operation of the door.

2. Apparatus for mounting a cavity mounted sliding door according to claim 1 wherein said support means comprises a substantially U-shaped bracket provided with legs and a bight portion, said legs providing means for fixing the support means to the head structure of said cavity, the bight portion providing said supporting surface.

3. Apparatus according to claim 2 wherein said support engaging formation comprises an aperture in said track means.

4. Apparatus according to claim 3 wherein said cavity is in part defined by a pair of vertical jamb members between which said door passes, spigot means being mounted adjacent to the inner face of at least one of said jamb members for engagement with said aperture in said track means, said spigot means being at a fixed location relative to said jamb members.

5. Apparatus according to claim 4 having a head piece provided with means for attaching the upper end of said at least one jamb member to the head structure of said cavity, said spigot means being supported by said head piece.

6. Apparatus according to claim 5 wherein said head piece comprises a first portion provided with means for fixing the head piece to said head structure, at least one first downwardly extending portion providing means for engaging a jamb, and a second downwardly extending portion, said spigot extending laterally from said second portion.

* * * * *